United States Patent [19]

Schlig et al.

[11] 4,104,563

[45] Aug. 1, 1978

[54] WRITING AND ERASING IN AC PLASMA DISPLAYS

[75] Inventors: Eugene Stewart Schlig, Somers; George Raymond Stilwell, Jr., West Nyack, both of N.Y.

[73] Assignee: International Business Machines Corporation, Armonk, N.Y.

[21] Appl. No.: 845,100

[22] Filed: Oct. 25, 1977

Related U.S. Application Data

[63] Continuation of Ser. No. 755,894, Dec. 30, 1976, abandoned.

[51] Int. Cl.[2] ..... H05B 41/14

[52] U.S. Cl. ..... 315/169 TV; 315/169 R

[58] Field of Search ..... 315/169 TV, 169 R; 340/324 M

[56] References Cited

U.S. PATENT DOCUMENTS 3,803,449 4/1974 Schmersal ..... 315/169 TV

*Primary Examiner*—Alfred E. Smith
*Assistant Examiner*—Charles F. Roberts
*Attorney, Agent, or Firm*—John A. Jordan; Bernard N. Wiener

[57] ABSTRACT

Improved writing and erasing in AC gas discharge display panels is obtained by applying a special normalizing voltage waveform to cause the cells to be in a more standardized state, so that the applied writing and erasing pulses act to cause wall voltage changes which are less sensitive to the cell's recent history. The special normalizing waveform is applied adjacent to the erase pulse and/or to the write pulse and acts to fire the cells in a manner such that there is no loss in the memory state of the cells.

15 Claims, 3 Drawing Figures

WRITING AND ERASING IN AC PLASMA DISPLAYS

This is a continuation of application Ser. No. 755,894, filed Dec. 30, 1976, now abandoned.

BACKGROUND OF THE INVENTION

1. Field of the Invention

The present invention relates to gas discharge display and memory devices and methods therefor. More particularly, the present invention relates to AC gas discharge display memory devices utilizing improved writing and erasing techniques.

2. Description of the Prior Art

Gas discharge display and memory panels of the type to which the present invention appertains are well-known in the prior art. For example, U.S. Pat. No. 3,499,167 to Baker et al describes such a display and memory panel. The gas panels of the type of which the present invention is directed typically utilize two glass plates, maintained in spaced-apart relationship, and are arranged to have sealed between the spaced-apart plates an ionizable gaseous medium. To provide matrix addressability whereby selected local regions within the ionizable medium may be selectively ionized, sets of horizontal and vertical conductors are employed. Typically, the set of horizontal conductors comprises an array of parallel insulated conductors arranged on the inner surface of one plate and horizontally extending thereacross. Likewise, the set of vertical conductors comprises an array of parallel insulated conductors arranged on the inner surface of the other plate vertically extending thereacross, generally orthogonal to the horizontal conductors.

In such an arrangement, when an appropriate voltage is applied between a selected one of the horizontal conductors and a selected one of the vertical conductors, ionization occurs at the cross-over point of the two conductors such that light is emitted. Generally, the cross-over points are referred to as "cells," and a display pattern or image is formed by ionizing selected cells. As another example of a panel as described and to which the present invention pertains, reference is made to an article by D. L. Bitzer et al entitled, "The Plasma Display Panel — A Digitally Addressable Display with Inherent Memory". Proceedings of the Fall Joint Computer Conference IEEE, San Francisco, Calif., November 1966, pp. 541–547.

One of the difficulties with conventional AC plasma display panels, as they exist today, resides in the fact that tight voltage margins in the erase and write operations result in high panel cost and reduced panel yield. As generally operated today, AC plasma display panels respond quite differently to write and erase operations. In general, errors in write pulse amplitudes due to cell and circuit margins produce errors in the "on-state" wall voltage (compared to the stable steady state value of wall voltage) which disappear within a very few sustain cycles because the wall voltage gravitates toward the stable point. On the other hand, errors in erase pulse amplitudes can produce "off-states" with improper wall voltages which persist for long times due to the lack of strong discharge activity in the off state. Even when this does not result in erase failures, it can reduce margins by causing the cells to respond incorrectly to subsequent write pulses and half-select pulses. As a consequence of this difference between write and erase operations, pulses of quite different wave shape are presently used for writing and erasing even though the voltage to be transferred, and so the intensity of the required discharge, is the same in the two cases.

In accordance with the principles of the present invention, an alternative writing and erasing scheme is proposed wherein the erase operation is followed and/or the write operation is preceded by strong discharge sequences which bring the wall voltage of each cell to the proper stable value for that cell. Although it is known in prior art gaseous discharge display panels to electronically condition the gaseous discharge by periodically causing unstable discharges at sites which are not in the "on" state, as taught for example in U.S. Pat. No. 3,559,190 or in U.S. Pat. No. 3,833,831, it is not known in the prior art to "normalize" the state of cells before writing and after erasing, with waveforms as taught in accordance with the present invention.

SUMMARY OF THE INVENTION

In accordance with the principles of the present invention, an AC gas discharge display and storage panel is provided with improved writing and erasing achieved by "normalizing" the state of the gas discharge cells. Normalizing is achieved for erase operations by supplying erased cells with one or more pulses of amplitude approximately twice that of normal sustain pulses (2 $V_s$ pulses). The normalizing pulses are applied after the erase pulse and prior to resuming normal sustain pulses or applying subsequent write pulses. Normalizing is achieved for write operations by supplying cells to be written with one or more pulses of amplitude approximately twice that of the normal sustain pulses, in a manner analogous to that described in regard to erase operations. This 2 $V_s$ pulse is applied just prior to the write operation. The 2 $V_s$ pulse acts to force the cells to fire once or twice, depending upon the initial state, at sustain strength prior to the write pulse. These discharges eliminate any erroneous initial wall voltages because it is a property of discharges at and above sustain strength that their residual gas voltages are virtually zero and virtually independent of the initial wall voltage and the amplitude of the applied voltage over a wide range.

In both the erase and write operations, the 2 $V_s$ pulse, in its most generally applicable form, exhibits a "front porch" portion or component of amplitude $V_s$, which portion is followed by the 2 $V_s$ pulse portion or component. After the 2 $V_s$ component of the normalizing waveform, a zero voltage "back porch" portion or component is required. Typically, the "front porch" portion of the 2 $V_s$ complex waveform acts to cause a firing in cells initially in the "on" state and to provide a smooth alteration between horizontal and vertical half-sustains, while at the same time keeping the voltage difference between the horizontal select and horizontal deselect lines unipolar. If normalizing pulses are to be applied in repetitive sequence to cells which are initially "on", a negative sustain pulse should follow each "back porch" portion before any subsequent 2 $V_s$ portion is applied.

Normalizing pulses may be applied either selectively only to those cells being erased or written, or else non-selectively to all cells of the panel simultaneously.

Since, in accordance with the normalizing approach of the present invention, the write and erase operations are made more similar than heretofore has been the case, as an alternative scheme, the same addressing waveshape, but with different peak amplitudes, can be used in both write and erase operations with good voltage margins. In accordance with the normalizing approach of the present invention, writing and erasing can be performed with pulses of lower amplitude and longer duration, with consequent reduction in line-driver circuit breakdown voltage ratings when the normalizing pulses are applied nonselectively.

It is, therefore, an object of the present invention to provide an improved AC gas discharge display panel.

It is a further object of the present invention to provide an AC gas discharge display panel having improved voltage margins.

It is yet a further object of the present invention to provide an AC gas discharge display panel with improved erase and write operations.

It is yet still a further object of the present invention to provide an AC gas discharge display panel wherein the state of the panel cells are normalized.

It is another object of the present invention to provide an AC gas discharge display panel which is lower in cost and which permits higher production yield.

It is yet another object of the present invention to provide an AC gas discharge display panel which allows the use of the same or similar waveshapes for both write and erase operations.

The foregoing and other objects, features and advantages of the invention will be apparent from the following more particular description of the preferred embodiments of the invention, as illustrated in the accompanying drawings.

DETAILED DESCRIPTION OF THE DRAWINGS

Figure 1:
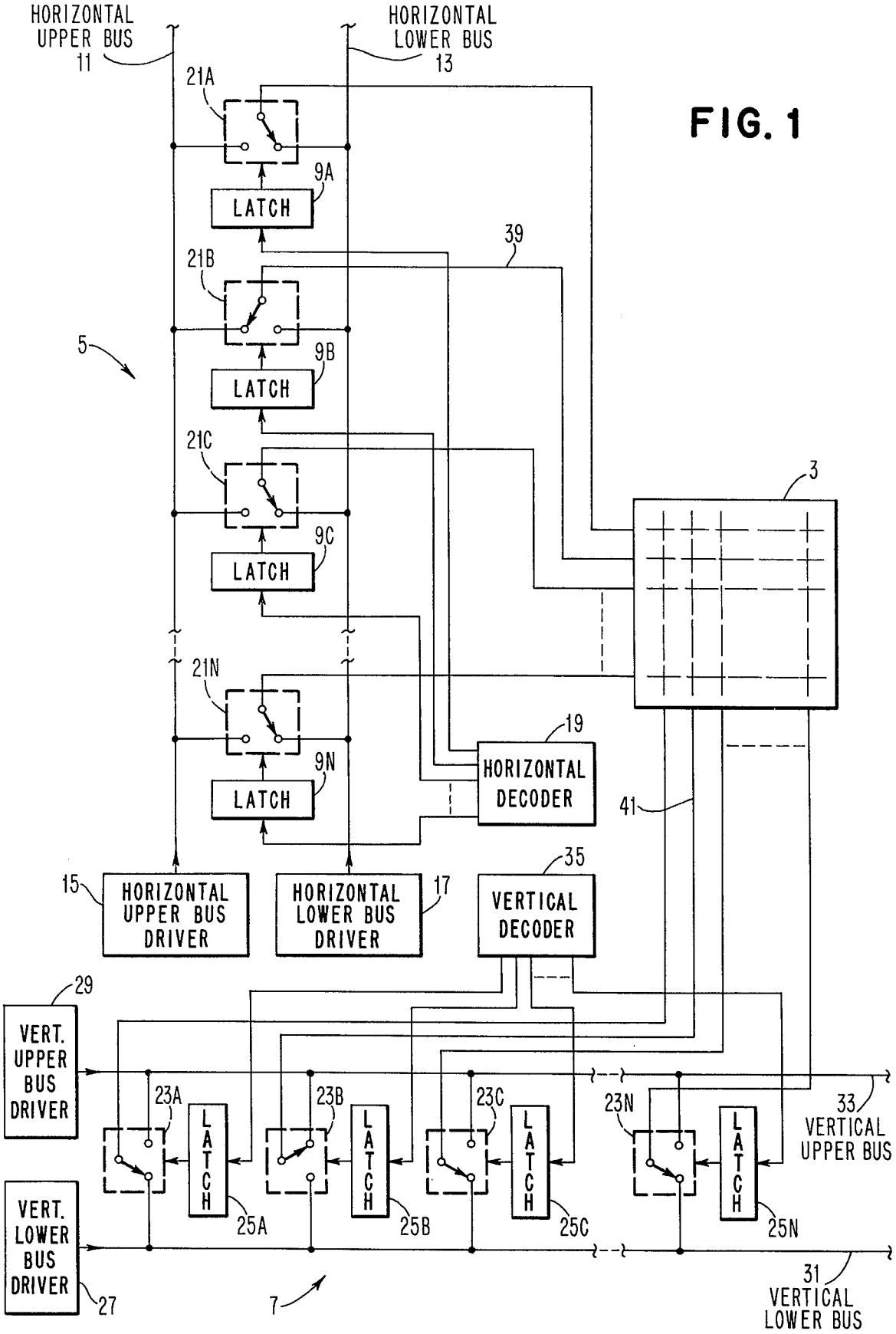
FIG. 1 shows a schematic of a four-rail gas discharge display panel system wherein provision is made for drive circuitry which applies the normalizing complex waveforms, as taught in accordance with the principles of the present invention.
Figure 2:
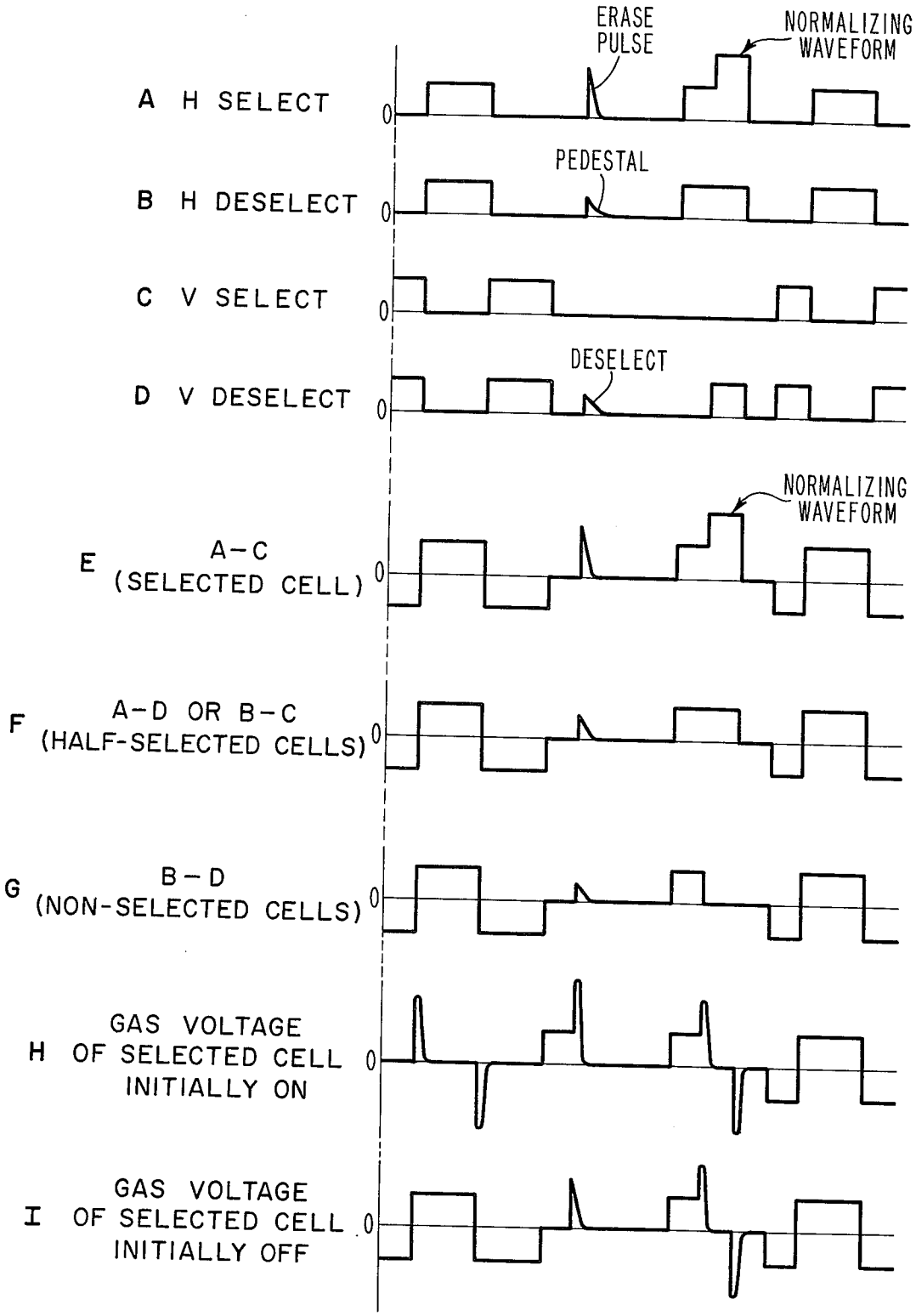
FIG. 2 shows a series of concurrent waveforms representative of the manner in which an erase operation may be carried out, in accordance with the principles of the present invention.
Figure 3:
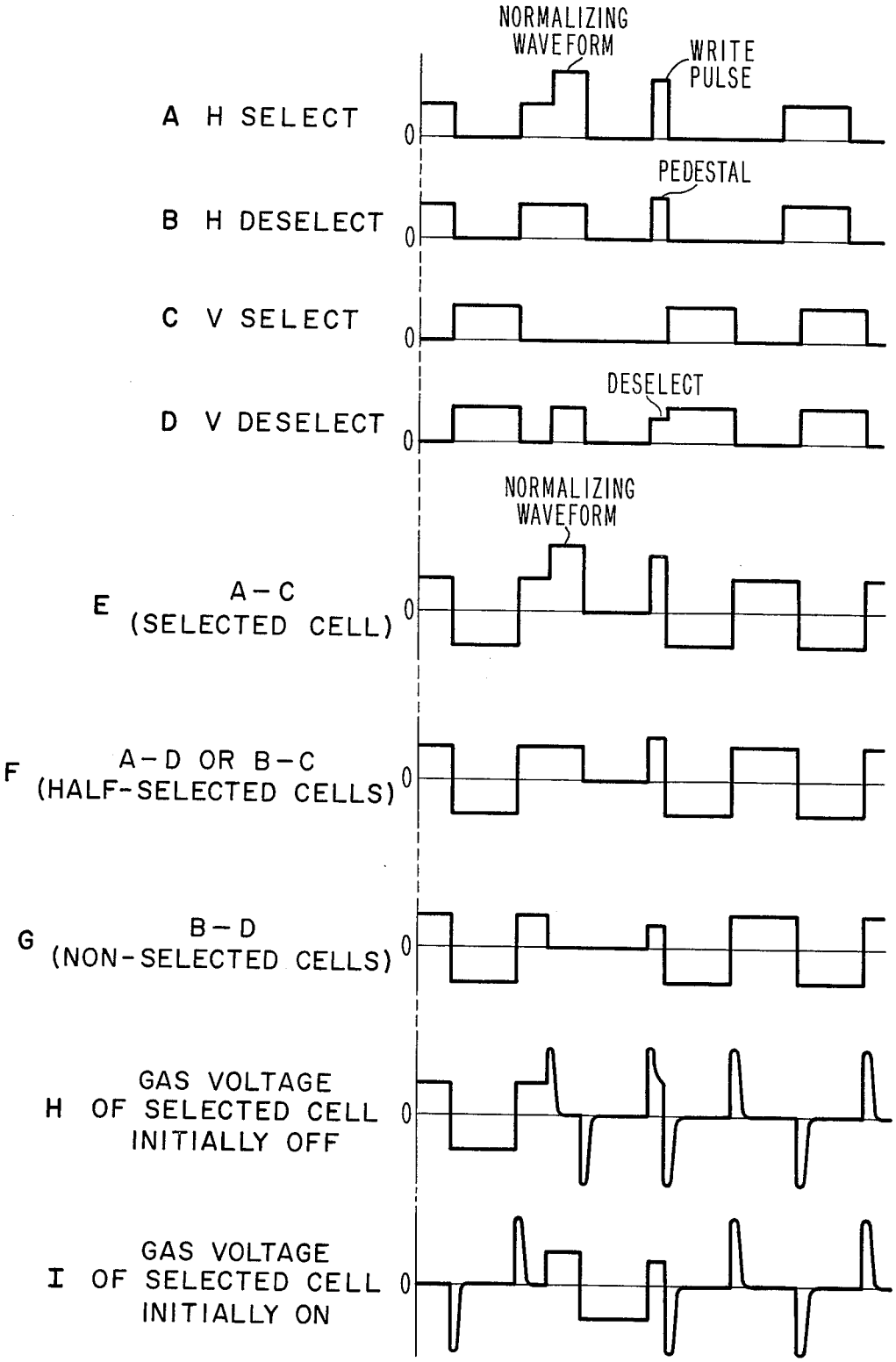
FIG. 3 shows a series of concurrent waveforms representative of the manner in which the write operation may be carried out, in accordance with the principles of the present invention.

The improved writing and erasing operations achieved in accordance with the methods and apparatus of the present invention by the waveforms, shown in FIGS. 2–3, may conveniently be implemented via the four-rail or bus-drive circuitry arrangement shown in FIG. 1. For a further description of four-rail or bus-drive circuitry per se, reference is made to copending appplication Ser. No. 372,384 entitled "Method and Apparatus for Gas Display Panel" by Criscimagna et al filed June 21, 1973 and assigned to the assignee of the present invention.

Before discussing the arrangement shown in FIG. 1, the series of concurrent waveforms shown in FIGS. 2 and 3 will be used to describe the erase and write operation, in accordance with the principles of the present invention, for the case of selective application of the normalizing waveform. As shown by the half-select waveforms in line A of FIG. 2, after the erase pulse and before resuming normal sustain, the erased cells (i.e., cells selected for erase) are supplied with the special normalizing waveform, in a manner hereinabove described. Typically, the normalizing waveform exhibits an amplitude approximately twice that of the normal sustain waveform. As shown in line A, the normalizing waveform comprises a first component of amplitude approximately equal to $V_s$ followed by a second component exhibiting an amplitude of approximately 2 $V_s$. The cell selected for erase as represented by the waveform of line E of FIG. 2 receives a complex normalizing voltage waveform comprising the $V_s$ component followed by the 2 $V_s$ component which in turn is followed by an interval of zero voltage prior to an excursion in the opposite direction. The horizontal deselect waveform (H Deselect) shown in line B is typical of that waveform conventionally applied during erase operations wherein a pedestal-type pulse is applied during the erase pulse time interval. Likewise, the vertical select waveform shown in line C of FIG. 2 is typical of the manner in which voltage is conventionally applied to the vertical select lines during erase operations. In similar fashion, the vertical deselect waveform shown in line D represents the typical manner in which voltage is conventionally applied during erase operations for the vertical deselect lines.

The waveform shown in line E of FIG. 2 represents the voltage applied across selected cells. As hereinabove mentioned, the normalizing waveform comprises a voltage interval of $V_s$ followed by another voltage interval of 2 $V_s$ with the latter interval being followed by an interval of time at approximately zero volts prior to an excursion in the direction opposite in polarity to that of the $V_s$ and 2 $V_s$ voltages. As shown by the waveform in line H of FIG. 2, the normalizing waveform causes at least two firings of a selected cell which is initially "on" but is turned "off" by the preceding erase pulse. These firings of the erased cell are of an intensity equal to the sustain firings but act to leave the cell in an off state at the conclusion of the special normalizing waveform and resumption of the sustain function. As hereinabove mentioned, the $V_s$ "front porch" component of the normalizing waveform is provided prior to the 2 $V_s$ component in order to obtain a smooth alteration between horizontal and vertical half-sustains while at the same time acting to keep the voltage difference between the horizontal select and horizontal deselect lines unipolar. This acts to simplify circuit requirements, as is understood by those skilled in the art. In principle, however, the $V_s$ "front porch" is not essential in the specific case illustrated in FIG. 2 because the selected cell is always "off" at the time of its application. The zero voltage "back porch" following the 2 $V_s$ component is required in order to achieve the second firing whereby the cell is returned to its off state. It is evident that variations in the makeup of the normalizing waveform may readily be made so long as the approximately $V_s$, approximately 2 $V_s$, and approximately zero voltage level prior to an opposite polarity excursion, exist in the order mentioned but not necessarily in direct sequence.

The three basic components of the normalizing voltage complex, i.e., a pulse of given polarity of sustain amplitude $V_s$, a pulse of the same polarity but approximately twice the sustain amplitude, and an interval of approximately zero volts may readily occur during separate time intervals as long as no voltage excursions which cause discharges, within the cells being addressed, intervene. In particular, it is required in accordance with the principles of the present invention that no voltage excursions to significant levels of the opposite polarity may intervene during the three voltage levels in question, i.e., sustain amplitude $V_s$, 2 $V_s$ and approximately zero voltage. It is clear, then, that any of a variety of combinations may be possible without causing intervening discharge within the selected cell.

In a manner analogous to that described with regard to FIG. 2, normalizing of cells selected for write operation may be carried out in accordance with the present invention by applying the same normalizing waveform as used to improve the erase operation. However, as shown by the horizontal select waveforms in line A of FIG. 3, the normalizing waveform is applied immediately prior to the write pulse. The horizontal deselect waveform and the vertical select and deselect waveforms shown in lines B, C, and D, respectively, represent the waveforms typically employed during conventional write operations. The selected cell, as represented by the waveform in line E, receives a voltage component thereacross of magnitude $V_s$ followed by a voltage component of magnitude 2 $V_s$. After the 2 $V_s$ component, an interval of zero volts occurs leading directly to the write pulse of the same polarity as the normalizing pulse waveform.

The half-select cells receive a waveform as shown in line F while nonselected cells receive a waveform as shown in line G of FIG. 3. As can be seen, the half-select and nonselect cells merely receive a pulse of $V_s$ during at least a portion of the normalizing time interval. The gas voltage for selected cells which are initially off is shown in line H of FIG. 3. As can be seen, two firings occur prior to the firing caused by the write pulse. The normalizing pulse acts to force the cells to fire at sustain strength prior to the write pulse. The residual wall voltage existing after the sustain-strength discharges is small and virtually independent of the initial wall charge and the degree of "priming" of the cell over a relatively wide margin. Thus, in accordance with the principles of the writing technique of the present invention, the write pulse is applied to a cell which is in a more standardized state, and so the wall voltage change it causes is thus less sensitive to the cell's recent history.

The gas voltage of selected cells which are initially "on" is shown in line I of FIG. 3. In this instance, the $V_s$ front porch serves the purpose of causing a discharge in the selected cell, leaving it with a negative wall voltage which prevents the write pulse from disturbing its state.

A drive circuitry arrangement is shown in FIG. 1 whereby the normalizing waveform may be applied to a conventional gas panel, in accordance with the principles of the present invention. For purposes of description, it can be assumed that the described erase and write operations are to be carried out for the cell formed by the intersection of lines 39 and 41. In other words, the horizontal and vertical select lines, for purposes of explanation, will be taken to be lines 39 and 41 in FIG. 1.

As shown in FIG. 1, latches 9A–9N in horizontal drive circuitry 5 act to latch switches 21A–21N. Switches 21A–21N are depicted schematically for illustrative purposes as single-pole double-throw switches. Typically, such latches would comprise bistable flip-flop circuits and such switches would comprise semiconductor switches with a single-pole double-throw function. Any of a variety of semiconductor switches may readily be used for such purposes.

Horizontal upper bus driver 15 in FIG. 1 feeds bus 11 and horizontal lower bus driver 17 feeds bus 13. Horizontal decoder 19, as is understood by those skilled in the art, acts to provide the decode logic for setting the states with latches 9A–9N in accordance with the information to be displayed upon panel 3. The horizontal upper and lower bus drivers 15 and 17 include the sustain waveform and the write and erase pulse generating means typically employed with the sustain waveforms to write and erase the panel, as is well understood by those skilled in the art. The superposition of a write and erase pulse on a sustain waveform may be achieved in any of a variety of ways, as is well understood by the artisan. In a manner analogous to that described with regard to horizontal drive circuitry 5, the vertical drive circuitry 7 employs switching circuitry 23A–23N to switch back and forth between an upper and lower bus, 33 and 31 respectively, to obtain the waveforms shown in FIGS. 2–4. Latches 25A–25N are set in response to the signals from vertical decoder 35. Vertical upper bus driver 29 feeds vertical upper bus 33, while vertical lower bus driver 27 feeds lower bus 31. With reference to the operation in FIG. 2, then, the normal horizontal sustain waveforms are derived from lower bus 13 in FIG. 1, while the normalizing waveform applied to line 39 is derived, via switch 21B, from upper bus 11. As is evident, during the normalizing time interval following the erase pulse, decoder 19 acts to cause latch 9B to act to latch switch 21B to the upper bus. In like manner, during the normalizing time interval following the erase pulse in question, vertical decoder 35 acts to cause latch 25B to cause switch 23B to latch line 41 to the vertical upper bus 33. After the normalizing waveform time interval, the horizontal and vertical switches are respectively latched to the horizontal and vertical lower buses. In this regard, it should be understood that when the normalizing mode is not employed, the four bus or rail system operates in a conventional manner, whereby each line of each axis of the panel receives 180° out-of-phase sustain pulses to sustain the information written into the panel. Typically, the upper bus of each axis applies the sustain pulses with the write and erases pulses being superimposed thereupon at appropriate times, via a transformer or the like. The lower bus of each axis may comprise a separate sustainer pulse source or, alternatively, may derive its pulses from the same sustainer pulse source as the upper bus driver. At write or erase time, then, the latches may be set so that all but the selected lines derive the sustain waveforms from the lower bus. Depending upon whether an erase or write operation is being considered, the normalizing waveform either follows or precedes the erase or write pulse on the upper bus. It should be understood that although FIG. 2 shows the normalizing waveform being supplied by the horizontal upper bus while the vertical upper bus applies no signal, the converse condition may as readily be employed whereby the vertical upper bus acts to apply the normalizing waveform to the selected line. It should also be understood that the normalizing waveform may as readily be derived from the lower buses. The exact manner in which the normalizing waveform is derived is a matter of choice, the significant point being that it should occur at the appropriate time with the sequence of magnitudes, as hereinabove described.

It should be appreciated that FIGS. 2 and 3 show typical erase and write pulse waveforms as employed in conventional AC gas discharge display panels. It is evident that many other erase and write pulse waveforms are known and may readily be combined with the normalizing waveform, in accordance with the principles of the present invention. Thus, the form of the erase or write pulse does not affect the operation of the normalizing waveform. It should also be appreciated that, because of the normalizing operation in accordance with the present invention, the write and erase operations are more similar. Accordingly, the same or similar waveshape, but with different peak amplitudes, may be used in both the erase and write pulse operations with good voltage margins. Thus, the erase and write pulses shown in FIGS. 2 and 3 may take the same form or different forms, with the selected form being any of a variety of well-known erase and write forms.

It should be appreciated that in each of the write and erase schemes described, the normalizing pulse need not be applied selectively to selected lines but may as readily be applied to all lines of one (or both) axis by means of the sustain driver. This acts to reduce the voltage breakdown requirement of the panel line-drivers in a four-rail circuit scheme. With such an arrangement, the entire panel will flash on during the 2 $V_s$ cycle but will return to its former state when the normal sustain resumes.

The sole purpose of applying the normalizing pulse selectively is to avoid the human factors problem associated with the flashing of the entire panel by the normalizing discharges, i.e., a loss of contrast. In relatively static displays which are erased and written infrequently, the nonselective scheme may be preferred to reduce circuit costs. In the nonselective case, the $V_s$ "front porch" must be present and a negative sustain pulse must occur between the "back porch" and any subsequent normalizing pulse.

It should be understood that under the operating conditions, as described in accordance with the principles of the present invention, writing and erasing can be performed with pulses of lower amplitude and longer duration, with a consequent reduction in line-driver circuit breakdown voltage ratings when the normalizing pulses are applied nonselectively. While the use of such write and erase pulses is known in the art, typically they are not used because margins are poor. The margin improvement obtained by the use of the normalizing pulse may readily be used to make such write and erase pulses practical.

It should also be understood that normalizing waveforms can optionally be used either only with erase or only with write operations rather than with both, as hereinabove described. Much of the advantage obtained from normalization can be retained if, for example, normalizing pulses are used only after erase operations.

On the other hand, by applying normalizing pulses, nonselectively to all cells, following the opposite-polarity sustain pulse which directly follows the write pulse (in addition to the erase and write normalizing pulses described above), additional benefit may be derived by eliminating possible disturbances of the state of "off" cells by write half-select pulses.

It should be recognized that the normalizing waveform, as described, may be utilized as in the noted U.S. Pat. No. 3,559,190 in a manner to avoid the necessity of pilot cells when writing into a panel. Typically, the normalizing waveform under such circumstances would be routinely applied at intervals to fire all or some set of the panel cells for one or more half-cycles. Such firing may be carried out at intervals sufficiently infrequent that the contrast ratio of the display is not significantly impacted. Such firings would act to allow the elimination of the rows of pilot cells (and their corresponding drivers) conventionally employed in AC panels.

In addition, such a utilization of the normalizing waveform would make possible faster write operations due to the fact that the need for several preparatory steps of writing would be obviated. Typically, in the write mode operation, peripheral pilot lines are first turned on. Then, an underlying cursor (which functions as a local pilot) must be written. The cursor is then erased and rewritten in a new position for each character to be written. The cursor is then turned off and the pilot lines at the periphery are turned off. By using the normalizing waveform to periodically exercise all the cells, such steps are unnecessary.

It should be appreciated that one of the major advantages of the normalizing waveform resides in the fact that in whatever manner it is utilized, it acts to return the cells addressed thereby to their original state, whether on or off.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of reducing error in the addressing operations of an AC gas discharge display panel via normalizing the state of addressed cells by applying a voltage complex to addressed cells during the erase and/or write cycle therefor, said voltage complex including at least a first component of at least one voltage level having a magnitude approximately equal to that of the magnitude of the sustain voltage level $V_s$ for said display panel, at least a second component of at least one voltage level having a polarity the same as the polarity of said at least one voltage level of said first component and a magnitude approximately equal to twice that of the sustain voltage level $V_s$, and at least a third component of at least one voltage level approximately equal to zero volts.

2. The method as set forth in claim 1 wherein said voltage complex is applied to addressed cells following an erase pulse.

3. The method as set forth in claim 1 wherein said voltage complex is applied to addressed cells preceding a write pulse.

4. The method as set forth in claim 1 wherein said at least a first component comprises an erase pulse.

5. The method as set forth in claim 1 wherein said at least a third component comprises a write pulse.

6. The method as set forth in claim 1 wherein said voltage complex is applied nonselectively to all cells.

7. The method as set forth in claim 6 wherein said voltage complex is applied nonselectively to all cells following the opposite polarity sustain pulse which directly follows a write pulse.

8. The method as set forth in claim 1 wherein between any two successive normalizing voltage complexes the first one thereof includes at least an excursion of amplitude approximately $V_s$ and a polarity opposite to that of said first and second components thereof after the occurrence of said third component thereof and prior to the occurrence of the second of said two voltage complexes.

9. In an AC gas discharge display system including an AC display panel and drive circuitry means therefor with said drive circuitry means having both horizontal and vertical drive circuitry means for providing addressing and sustain pulses to respective horizontal and vertical lines of said panel and with said addressing pulses including erase and write pulses occurring during the respective erase and write cycles thereof, the improvement comprising a drive circuitry arrangement for providing normalizing pulses to addressed cells to thereby reduce addressing errors, said drive circuitry arrangement including pulse means in each of said horizontal and vertical drive circuitry means for producing a normalizing voltage pulse waveform having at least a first component of at least one voltage level having a magnitude approximately equal to that of the magnitude of the sustain voltage level $V_s$ for said display panel, at least a second component of at least one voltage level having a polarity the same as the polarity of said at least one voltage level of said first component and a magnitude approximately equal to twice that of the sustain voltage level $V_s$, and at least a third component of at least one voltage level approximately equal to zero volts.

10. The display system as set forth in claim 9 wherein said voltage pulse waveform includes at least an excursion of amplitude approximately $V_s$ and of polarity opposite to that of said first and second components after the occurrence of said third component and prior to the occurrence of any subsequent normalizing voltage complex.

11. The display system as set forth in claim 10 wherein each of said horizontal and vertical drive circuitry means includes both an upper and lower bus and means for switching between said upper and lower bus so that the voltage levels applied to one bus may always be at least as large as the other.

12. The display system as set forth in claim 11 wherein said pulse means provide a normalizing voltage pulse waveform prior to said write pulse and subsequent to said erase pulse.

13. The display system as set forth in claim 9 wherein said at least a first component comprises an erase pulse.

14. The display system as set forth in claim 9 wherein said at least third component comprises a write pulse.

15. The display system as set forth in claim 14 wherein said voltage pulse waveform is applied nonselectively to all cells following the opposite polarity sustain pulse which directly follows a write pulse.

* * * * *